US005928471A

United States Patent [19]

Howland et al.

[11] Patent Number: 5,928,471

[45] **Date of Patent: *Jul. 27, 1999**

[54] SECURITY FEATURES FOR PAPER

[75] Inventors: Paul Howland, Andover; Robert John Furley, Ingatestone, both of United Kingdom

[73] Assignee: Portals Limited, London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/617,775

[22] PCT Filed: Sep. 16, 1994

[86] PCT No.: PCT/GB94/02015

§ 371 Date: Mar. 20, 1996

§ 102(e) Date: Mar. 20, 1996

[87] PCT Pub. No.: WO95/09275

PCT Pub. Date: Apr. 6, 1995

[30] Foreign Application Priority Data

Sep. 27, 1993 [GB] United Kingdom ..... 9319872

[51] Int. Cl.[6] ..... D21H 21/40

[52] U.S. Cl. ..... 162/110; 162/134; 162/140; 162/184; 162/158

[58] Field of Search ..... 162/110, 109, 162/134, 135, 137, 140, 158, 265, 266, 184, 186; 427/161

[56] References Cited

U.S. PATENT DOCUMENTS

| | | | |
|---|---|---|---|
| 672,582 | 4/1901 | Affeltranger et al. | 162/110 |
| 1,787,218 | 12/1930 | Trask | 162/134 |
| 2,123,399 | 7/1938 | Bright | 162/134 |
| 3,813,261 | 5/1974 | Muller | 427/161 |
| 4,513,056 | 4/1985 | Vernois et al. . | |

FOREIGN PATENT DOCUMENTS

| | | | |
|---|---|---|---|
| 696673 | 9/1953 | United Kingdom | 162/140 |
| 1489084 | 10/1977 | United Kingdom . | |

*Primary Examiner*—Peter Chin

*Attorney, Agent, or Firm*—Watson Cole Grindle Watson, P.L.L.C.

[57] ABSTRACT

The invention relates to improvements in security features in paper and in particular to a method of making paper and transparentising selected areas of paper to provide enhanced security features. The invention thus provides a method of making paper comprising the step of depositing fibers (12) onto a support surface (13) to form a porous absorbent sheet (14), applying a transparentising resin to at least portion of said porous sheet and subsequently impregnating the porous sheet with a sizing resin.

15 Claims, 2 Drawing Sheets

SECURITY FEATURES FOR PAPER

BACKGROUND OF THE INVENTION

1. Field of the Invention

The invention relates to improvements in security features in paper, and in particular to a method of making paper and transparentising selected areas of paper to provide enhanced security features.

2. The Prior Art

Documents of value and means of identification, such as banknotes, passports, identification cards and the like, are vulnerable to copying or counterfeiting. The increasing popularity of colour photocopiers and other imaging systems, and the improving technical quality of colour photocopiers, has led to an increase in the counterfeiting of such documentation. There is, therefore, a need to improve the security features of such documentation, or paper, to add additional security features or to enhance the perceptions and resistance to simulation of existing features. Steps have already been taken to introduce optically variable features into such documentation which cannot be reproduced by a photo-copier. There is thus a demand to introduce features which are discernible by the naked eye but "invisible" to, or viewed differently by, a photocopier. Since a photo-copying process typically involves reflecting high energy light of an original document containing the image to be copied, one solution is to incorporate one or more features into the document which have a different perception in reflected and transmitted light. Known examples of such security features include watermarks, embedded security threads, fluorescent pigment and the like.

EP-A2-0203499 discloses a method of applying a pseudo watermark to paper. This method comprises the preparation of a paper containing thermally sensitive material, the presence of which renders the translucency of the paper variable by temperature change. When heat is subsequently applied to a part of the surface of the paper, a region of the paper becomes semi-translucent.

U.S. Pat. No. 2,021,141 discloses a method of applying pseudo watermarks to paper, by applying a resinous composition to finished paper which permeates the paper and causes it to become more transparent, or translucent, than the surrounding area.

GB-A-1489084 describes a method of producing a simulated watermark in a sheet of paper. The sheet is impregnated in the desired watermark pattern with a transparentising composition which, when submitted to ultra violet radiation, polymerizes to form a simulated watermark.

U.S. Pat. No. 5,118,526 describes a method of producing simulated watermarks by applying heat, in the desired watermark pattern, onto a thin solid matrix of waxy material placed in contact with a sheet of paper. This results in an impression of a durable translucent watermark.

U.S. Pat. No. 4,513,056 relates to a process for rendering paper either wholly or partially transparent by impregnation in a special bath of a transparentization resin and subsequent heat cross-linking of the resin.

EP-A1-0388090 describes a method of combining a see-through or print-through feature with a region of paper which has a substantially uniform transparency which is more transparent than the majority of the remainder of the sheet.

JP 61-41397 discloses a method for making paper transparent and a method for its manufacture for see-through window envelopes. The method utilises the effect of causing ink cross-linked by ultra-violet rays to permeate paper thus causing that part of the paper to become transparent.

All of these methods providing enhanced security features are for use with finished paper and for non-currency and non-security papers. They can be applied to wood pulp based papers for high volume commercial applications. Such substances are still quite porous with little inherent oil or grease resistance and the transparentising can be successful. Furthermore, in such applications it is highly desirable to have the transparentization step as a separate process. Web printing processes are very fast, whereas paper making processes are often much slower. Since there is a certain amount of spoilage in paper making, incorporating an additional process in the paper making has generally been avoided to avoid an increase in the spoilage. None of the prior art method are furthermore particularly suitable for low absorbency low porosity papers, such as are used for banknotes (banknote paper typically will exhibit a porosity of up to 25 ml/minute, measured by the Bendtsen method). Such papers have generally been treated so as to minimise the uptake of oily substances and organic solvents. This is generally achieved by using a fibrous substrate designed to reduce the porosity of the paper and by impregnating the paper with any one of a variety of sizing resins such as polyvinylalcohol or gelatine and also by calendering the paper. The sizing and calendering processes help to reduce the porosity of the paper. Finished paper treated in this way does not lend itself to transparentization because its low absorbency inhibits the penetration of the transparentising resin, and, in the case of UV cured resins or those requiring a hot drying process, the moisture content of the paper is disturbed and this is likely to cause print runability problems at the print stage.

It is an object of the present invention to provide a method of manufacturing paper, in particular security paper, of which at least a portion is transparentized to provide an enhanced security feature in counterfeiting or copying.

SUMMARY OF THE INVENTION

According to the invention there is provided a method of making security paper comprising the steps of depositing fibers onto a support surface to form an unfinished porous absorbent sheet, applying a transparentising resin to at least a portion of said porous sheet, subsequently impregnating the porous sheet with a sizing resin, and then further processing it to form a sheet of finished security paper.

A preferred embodiment of the present invention will now be described in detail, by way of example only, with references to the accompanying drawings.

DETAILED DESCRIPTION OF THE PREFERRED EMBODIMENTS

Figure 1:
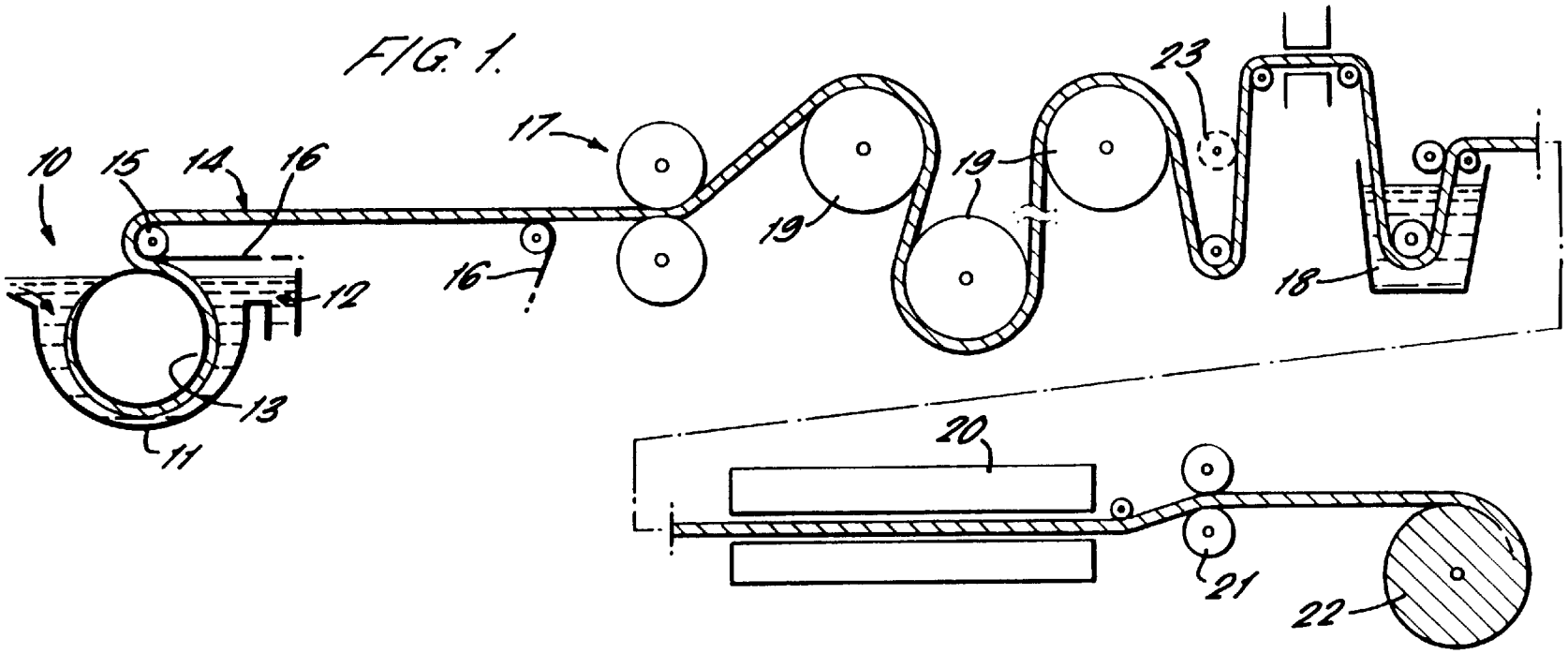
FIG. 1 is a schematic section through apparatus used in a method of manufacturing paper according to the invention.

Referring to FIG. 1, there is shown a cylinder mold paper making machine 10 comprises a vat 11 containing paper stock, i.e., a suspension of paper making fibers 12. The major portion of a horizontal cylinder mold 13 dips into the vat 11. The surface of the cylinder 13 is provided by a wire mesh which may be embossed and generally there are several layers of mesh employed, the outermost being the finest. Liquid is drawn through the mesh as the cylinder 13 is rotated causing paper making fibers to deposit on the mesh and form wet paper 14. The wet paper 14 is couched from the cylinder by couch roll 15 and conveyed away on a moving wire mesh 16.

The wet paper 14 then passes through a wet press 17 which squeezes the paper 14 to remove excess water therefrom. The paper 14 is then dried over heated cylinders 19.

Figure 2:
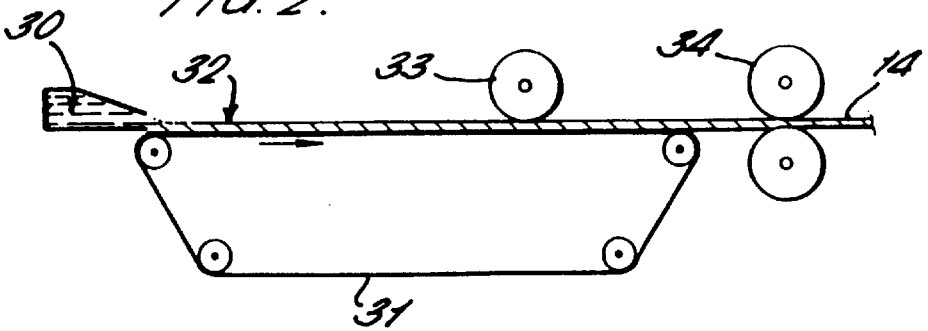
FIG. 2 is a schematic section through alternative paper making apparatus for use in the method of manufacturing paper according to the invention.

Although the present invention is described with reference to a cylinder mold paper making machine, which is the preferred method, the paper forming process can be achieved in many other ways. The most common alternative is the Fourdrinier system shown in FIG. 2. In this paper making machine fibre stock is deposited from a stock applicator or flow box 30 on to a continuous moving wire mesh 31. Water from the fibre stock drains through the wire mesh 31 leaving a wet de-watered fibre mat 32. The fibre mat 32 passes under a dandy roll 33 which can be used to apply an embossed watermark. The wet paper then passes through a wet press 34 before being dried.

In a traditional paper making process the paper is impregnated with any one of a variety of sizing resins such as polyvinylalcohol (PVOH) or gelatin, to minimise the uptake of oily substances or organic solvents. The paper sheet 14 is passed through a size bath 18 so that it becomes saturated with size. The resulting paper is thus resistant to grease and has a lower abosorbency and it is therefore more appropriate for use as banknote paper and the like. The paper sheet 14 is then passed through an air float or spar dryer 20 for further drying before passing to a calendering device 21 to give a smooth surface before reeling 22.

Figure 3:
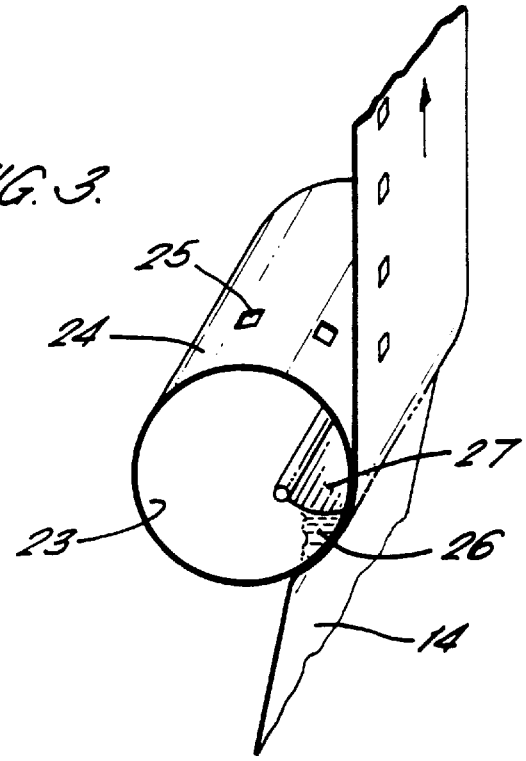
FIG. 3 is a perspective view of the rotary screen printer of FIG. 1.

In the modified process according to the invention, a screen printing process or other resin applicator is used to apply a transparentising resin to the surface of the partially formed paper sheet 14 before it enters the size bath 18. This is shown in more detail in FIG. 3. The screen printer 23 is a rotary printer comprising a cylindrical screen 23 of flexible wire mesh mounted on a rigid steel rim covered by a stencil 24. The image required to be reproduced on the paper is formed in the stencil by means of an opening 25. As the paper sheet 14 passes the cylinder, the transparentising resin 26 is applied to the inside of the wire mesh and forced through the mesh with a squeegee blade 27 onto the paper sheet 14.

At this point the partially formed paper is at its most absorbent, thus allowing good penetration of the transparentising resin. In one embodiment of the invention, no curing process is used, and the sheet 14 is passed directly into the size bath 18. This prevents smudging of the mobile transparentising resin which is effectively frozen in position. This is an unexpected effect. As soon as the sheet 14 enters the size bath 18, the size fills the cells in the paper surrounding those containing the transparentising resin, thus preventing migration of the latter. The transparentising resin can thus be applied to a sharply defined region of the paper so as to create a transparent patch or pattern that is capable of contributing to the overall and counterfeitability of a security document made from the paper. The security document may be a banknote, a cheque, a passport, an identification card, a share certificate or the like.

Figure 4:
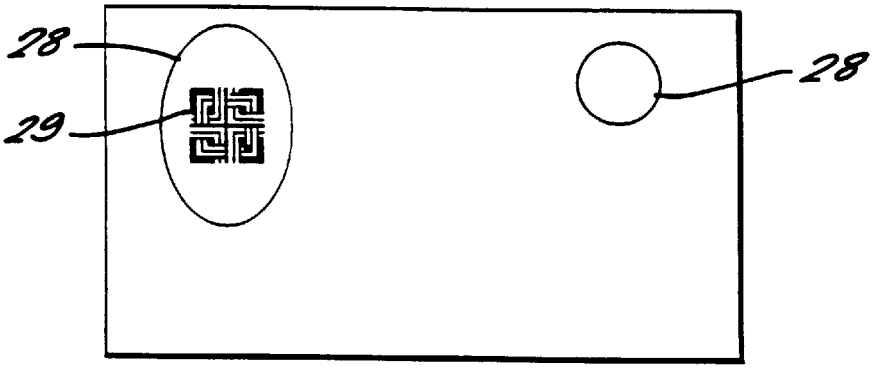
FIG. 4 is a schematic representation of a security document made from paper according to the invention.

An example of a security document made by this process is illustrated in FIG. 4 which shows a sharply defined translucentized area 28. It should be noted that the transparentized area does not reflect as much light as the non-transparentized paper. Therefore the outline of the transparentized patch can be seen reasonably well in reflected light. This provides a further enhancement of the anticounterfeit ability of a security document as it shows benefits in reflected as well as transmitted light.

In an alternative embodiment of the invention, the resin can be "fixed" by using EB or UV radiation cured resins whereby curing takes place shortly after application and prior to entry of the sheet 14 into the size bath 18. These resins have the advantage that, once cured, they are fixed and controlled.

Alternatively, the radiation cross-linking could take place between the air float dryer and the calender thereby providing the transparentising resin for a longer period of time to penetrate the paper 14.

When paper is produced using the process described, two additional techniques can be applied to the process in order to increase the receptivity of the paper sheet 14 to the transparentising resin.

The resin can be applied to a low grammage part of the paper created by the well known processes of mold or dandy roll water marking. This results in a very significant enhancement of the watermark as the contrast between the light and dark areas in the watermark are significantly greater. In the case of mold made watermarks, this also has the advantage of the creating a local area low in opacifying pigment such as titanium dioxide which further increases the transparentising effect of the transparentising resin.

Instead of applying a resin to a plain low grammage part of the paper, the transparentising resin can also be applied to a decorative watermark 29, as shown in FIG. 4. This significantly extends the usefulness of the transparentising features as a deterrent to counterfeiters by markedly increasing its visual complexity and by generating within it an easily recognizable yet difficult to copy image.

When the translucency is controlled to give an opacity not less than 50%, an unexpected advantage is that the outline definition of the watermark is noticably enhanced.

Figure 5:
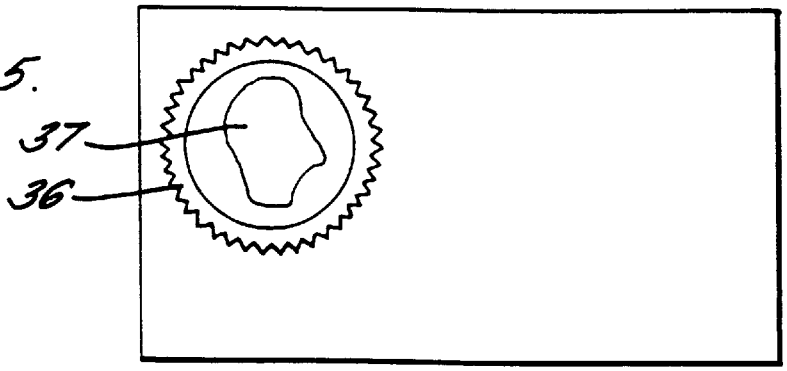
FIG. 5 is a schematic representation of an alternate security document made from paper according to the invention.

In yet another alternative embodiment of the invention, illustrated in FIG. 5, the resin can be applied as an outline or frame 36 around a watermark 37 or a low grammage patch of the paper which has the effect of drawing attention to the watermark.

Alternatively, or in addition to the use in relation to a watermark, the transparentising resin can be applied to a streak in the paper. In the manufacturing of paper using a cylinder mold machine 10, it is possible to use a fibre locator to direct different types of fibers to certain places on the mold thus causing a streaking effect in the resulting paper. These different types of fibers may create a streak of more porous paper structure. Where such a streak is created it has the effect of enabling the transparentising resin to absorb into the area of streak better than the surrounding paper and as such can therefore be used to enhance the transparentising effect.

Alternatively, or in addition, a dye may be added to the transparentising resin. This can provide a striking and aesthetically pleasing effect to the transparentised areas. If the dye is fluorescent a very important commercial advantage can be obtained since an ultra-violet lamp can give a transmitted fluorescence which is normally only available in reflected light.

Additionally the flourescent transparentising resin may be applied to a decorative watermark. The result of the feature which, when viewed in UV transmitted light, reveals the watermark of the shadows. This is an unexpected effect and because of its striking appearance it is a useful security feature.

In yet another embodiment of the invention, the effect of the transparentising resin can be enhanced by the known process of intaglio printing which has the effect of embossing the paper. The combination of heat and pressure used in the intaglio embossing process improves the distribution of resin through the paper, except in the case of non-thermo plastic resins such as the radiation cured type.

In order to maximise the transparentising effect of the resin, paper with a minimum of titanium dioxide ($TiO_2$), added to make paper more opaque and even out appearance, or other opacifying pigment needs to be used so as to achieve satisfactory see-through and strike-through in non-transparent areas.

In yet another embodiment of the invention, the transparent features applied in register with the watermark in both the machine and cross-direction. Unregistered features have the inherrent advantage of technical simplicity, but by the same token are considered by many to be easier to counterfeit in quantity than registered features. Such a process requires the use of optical detectors that identify the watermark position and feeds this information back to the electronic unit that controls the drive of the printing screen in the case of screen printing. Alternatively, in the case of other printing methods, web tension control may be the mechanism by which register is achieved.

Examples of materials and compositions suitable for use in making paper according to the invention will be discussed as follows.

Paper-Making Fibers

Papers suitable for banknotes and security documentation are made from a variety of fibers such as linen, abaca, wood pulp, cotton and blends thereof. Wood pulp is commonly used in non-banknote security documents, whilst cotton is the preferred fibre for banknotes. These cotton fibresare often from waste materials, such as off-cuts from the textile industry. The processed fibers have a ribbon-like profile which have a high surface-to-surface contact area. However, to produce approprite cotton fibers for manufacturing banknote paper and the like. The fibers must be refined from their original tubular configuration by the mechanical process of defribrillation. In order achieve a high quality base paper, it is necessary to ensure that the preparation of the fibers is carefully carried out and that they are manipulated and defibrillated to the most appropriate length and orientation to achieve a good quality watermark, whilst also maintaining the high strength needed for paper. Such paper generally has a Schopper Riegler value of 45–70. Despite careful processing, the fibers are natural fibers and can vary from batch to batch, resulting in a variation of the porosity of the paper. Further porosity variations result from different specification demanded by different customers.

Sizing Resins

It should be noted that the sizing resins referred to are surface sizing resins, as opposed to internal sizing resins. Preferably, traditional sizing resins such as polyvinylalcohol (PVOH) or gelatin are used as functionally these are generally the most successful. There are, however, many other chemicals which can be used such as starch or emulsion based polymers.

Because of the variation in the quality of the paper fibers, the concentration of the size may also be varied during processing.

Transparentising Resins

As mentioned above, these may be known ultra violet (UV) curable, non-curable and cross-linkable resins.

The process of screen printing the transparentising resin onto the paper sheet 14 and the time taken for the resin to be absorbed into the paper depends, amongst other things, on the viscosity of the resin. As paper making machines run at different speeds and the properties of the base paper fibers can vary, it is necessary to control the viscosity of the resin in order to control the transparency of the paper. It is therefore recommended that two resins are taken from different ends of the viscosity spectrum, which can be blended to form a resin at an appropriate viscosity for the machine speed, the level of transparency to be achieved, the rate of absorbtion, and so on. Another option is also to add different levels of a wetting agent such as FC-430 Fluorad (trade mark) supplied by 3M which is a fluoroaliphatic polymericester. Thus if the base paper is of a lower porosity than ideal, such a wetting agent can be mixed with the resin and added at the screen printing stage.

UV-Curable Resins—The preferred resins are 100% resins with no solvent incorporated. They have a Refraction Index in the region of 1.5 and a viscosity in the region of 400–1500 centipoise at 23° C. They should preferably be non-yellowing and transparent. As curable resins harden, it is also necessary that they should have appropriate physical strength requirements. For example, they must not be brittle when they are bent.

Examples of such resins are Photomer 4061 (trade mark) which is a tripropylene glycol diacrylate and Photomer 5018 (trade mark) may be used, which is a polyester tetrofunctional acrylate, both supplied by Harcros Chemical (UK) Limited. These resins are generally at the opposite ends of the viscosity spectrum and can be combined to provide a suitable transparentising resin at an appropriate viscosity.

Non-curable resins—The physical criteria for a suitable non-curable resin are basically the same as those of the UV curable resins. Suitable materials include polybutene material such as Hyvis 7 (trade mark) which is a polyisobutylene supplied by BP Chemicals or Hyvis 5 (trade mark) which is also a polyisobutylene supplied by BP Chemicals. Hyvis 5 has a higher viscosity than Hyvis 7.

It should be noted that the non-curable resins generally stay in the liquid state and have no physical strength requirements.

Cross-linkable resins—It is suggested that resins such as epoxy and alkyd resins may also be used. However, it is important that a number of these take some considerable time to cure. If the change has not taken place by the time the paper is reeled, the whole reel of paper is glued together or resin transfer to adjacent sheets can occur.

When non-curable and cross-linkable resins are used, it is necessary that the amount added is carefully controlled. Since these resins do not actually cure, it is important that the paper is not saturated, which could mark adjacent paper on the reel.

We claim:

1. A method of making a continuous roll of banknote paper on a paper making machine, said banknote paper having a low porosity and having a plurality of discrete transparentised regions repeating along the length of the paper, and also having a plurality of discrete areas repeating along the length of the paper which are at least partly of a lower grammage than surrounding areas, so as to provide lighter and darker areas in said areas which are enhanced by said transparentised regions, said method comprising the steps of (a) continuously depositing an aqueous fibrous suspension onto a support surface to form continuous wet paper sheet;

(b) forming in the wet paper sheet a series of discrete areas repeating along the length of the sheet which are at least partly of a lower grammage than surrounding areas;

(c) draining liquid from said wet paper sheet to form a continuous unfinished porous absorbent sheet;

(d) printing a plurality of locations in said unfinished porous sheet with a transparentising resin to provide transparentised regions which cooperate with the discrete lower grammage areas to enhance the visibility thereof, which transparentising resin is absorbed into the sheet;

(e) passing said unfinished porous sheet having the discrete printed transparentised regions through a surface sizing impregnating device so as to impregnate said porous sheet with surface sizing, such that the surface sizing surrounds the transparentised regions;

(f) drying the resulting sized porous sheet to form a dried porous sheet;

(g) calendering said dried porous sheet; and (h) reeling the resulting sheet into a roll of finished banknote paper.

2. A method as claimed in claim 1, wherein said printing comprises screen printing.

3. A method as claimed in claim 1, wherein said transparentising resin is a non-curable or cross-linkable resin.

4. A method as claimed in claim 1, wherein said transparentising resin is a curable resin when subjected to ultraviolet or electron beam radiation.

5. A method as claimed in claim 4 further comprising the step of subjecting the porous sheet to ultra-violet radiation to cure the transparentising resin before impregnation with the sizing resin.

6. A method as claimed in claim 1, in which the transparentising resin is applied to at least partially overlap said discrete lower grammage areas.

7. A method as claimed in claim 1, in which the transparentising resin is applied in a border around at least some of said lower grammage areas.

8. A method as claimed in claim 1 in which the lower grammage areas are watermarks.

9. A method as claimed in claim 1 further comprising the step of creating in the porous sheet a streak of fibres of a different type to those of the porous sheet and applying the transparentising resin to at least a part of said streak.

10. A method as claimed in claim 1, including adding a dye or pigment to the transparentising resin.

11. A method as claimed in claim 1, including adding a wetting agent to the transparentising resin.

12. A method as claimed in claim 1, including controlling the viscosity of the transparentising resin to control the transparency of the paper.

13. A method as claimed in claim 1 further comprising the step of embossing the paper using a combination of heat and pressure.

14. Low porosity, low absorbency banknote paper produced by the method as claimed in claim 1.

15. A method as claimed in claim 7 in which the low grammage area is a watermark.

* * * * *

UNITED STATES PATENT AND TRADEMARK OFFICE

CERTIFICATE OF CORRECTION

PATENT NO. : 5,928,471
DATED : July 27, 1999
INVENTOR(S) : Paul Howland et al.

It is certified that error appears in the above-identified patent and that said Letters Patent is hereby corrected as shown below:

Title page,
Item [73], should read:
-- [73] Assignee: Portals Limited, London, United Kingdom; The Governor and Company of The Bank of England, London, United Kingdom --

Signed and Sealed this

Tenth Day of June, 2003

JAMES E. ROGAN
*Director of the United States Patent and Trademark Office*